United States Patent [19]

Gray et al.

[11] Patent Number: 4,584,173

[45] Date of Patent: Apr. 22, 1986

[54] ALUMINIUM ALLOYS

[75] Inventors: Alan Gray, Amersham; William S. Miller, Maidstone, both of England

[73] Assignee: Alcan International Limited, Montreal, Canada

[21] Appl. No.: 658,905

[22] Filed: Oct. 9, 1984

[30] Foreign Application Priority Data

Oct. 12, 1983 [GB] United Kingdom ..... 8327286

[51] Int. Cl.[4] ..... C22C 21/00

[52] U.S. Cl. ..... 420/533; 420/532

[58] Field of Search ..... 420/532, 533; 148/417, 148/418, 439

[56] References Cited

PUBLICATIONS

AIME Symposium Paper published as "1st Aluminium–Lithium Conference Proceedings 1980," edited by T. H. Saunders & E. A. Starke, pp. 205–227, ISBN 0–89520–373–1.

*Primary Examiner*—R. Dean

*Attorney, Agent, or Firm*—Sheridan Neimark; Karl W. Flocks

[57] ABSTRACT

An aluminium base alloy having a composition within the following ranges in weight percent:

| | |
|---|---|
| Lithium | 2.1–2.9 |
| Magnesium | 3.0–5.5 |
| Copper | 0.2–0.7 and |

one or more constituents selected from the group consisting of Zirconium, Hafnium and Niobium as follows:

| | |
|---|---|
| Zirconium | 0.05–0.25 |
| Hafnium | 0.10–0.50 |
| Niobium | 0.05–0.30 and |
| Zinc | 0–2.0 |
| Titanium | 0–0.5 |
| Manganese | 0–0.5 |
| Nickel | 0–0.5 |
| Chromium | 0–0.5 |
| Germanium | 0–0.2 |
| Aluminium | Remainder (apart from incidental impurities). |

5 Claims, No Drawings

ALUMINIUM ALLOYS

FIELD OF THE INVENTION

This invention relates to aluminium-lithium alloys.

DESCRIPTION OF THE PRIOR ART

Alloys based on the aluminium-lithium system have long been known to offer advantages relating to stiffness and weight reduction.

Previous aluminium-lithium alloys have been based either upon the Al—Mg—Li system containing, for example, 2.1% Li and 5.5% Mg (U.K. Pat. No. 1172736, Dec. 3, 1969) or by the addition of relatively high levels of lithium to conventional alloys via powder metallurgy (for example K. K. Sankaran, MIT Thesis, June 1978). More recently, additions of magnesium and copper have been proposed, for example lithium 2–3%, copper 1.0–2.4%, magnesium $<1.0\%$ (for example U.K. Patent Application No. 215836A which discloses a magnesium content of 0.4% to 1.0% by weight).

Current targets for a density reduction of 6.10% are frequently quoted for the more recent generation of aluminium-lithium alloys developed for commercial exploitation, when compared with the 2000 and 7000 series aluminium alloys, for example 2014 and 7075.

Alloys based on the Al—Mg—Li system are deficient in their difficulty of fabrication, poor yield strength and low fracture toughness but have good corrosion behaviour. Alloys based on the Al—Li—Cu—Mg system, as developed to date, have improved fabrication qualities, strength and toughness characteristics but relatively poor corrosion behaviour.

We have subsequently found that by modifying the concentration of the major alloying elements (Li, Cu, Mg) in the Al—Li—Cu—Mg system it is possible to combine the ease of fabrication, strength and fracture toughness properties known to exist within the system with the corrosion resistant properties of the Al—Mg—Li alloys developed to date.

SUMMARY OF THE INVENTION

Accordingly, there is provided an aluminium base alloy having a composition consisting essentially of the following ranges in weight percent:

| | |
|---|---|
| Lithium | 2.1–2.9 |
| Magnesium | 3.0–5.5 |
| Copper | 0.2–0.7 and |

one or more constituents selected from the groups consisting of Zirconium, Hafnium and Niobium as follows:

| | |
|---|---|
| Zirconium | 0.05–0.25 |
| Hafnium | 0.10–0.50 |
| Niobium | 0.05–0.30 and |
| Zinc | 0–2.0 |
| Titanium | 0–0.5 |
| Manganese | 0–0.5 |
| Nickel | 0–0.5 |
| Chromium | 0–0.5 |
| Germanium | 0–0.2 |
| Aluminium | Remainder (apart from incidental impurities) |

When the alloy contains zirconium the preferred range is 0.1 to 0.15 weight percent and it will be understood that such zirconium will normally contain 1.0 to 5.0 weight percent hafnium. The optional additions of Ti, Ni, Mn, Cr and Ge may be used to influence or control both grain size and grain growth upon recrystallisation and the optional addition of zinc improves the ductility of the material and may also give a strength contribution.

Alloys of the Al—Mg—Li—Cu system have a density of, typically, 2.49 g/ml. Given in Table 1 is a comparison of calculated density values for medium and high strength Al—Li—Cu—Mg alloys and a medium strength Al—Mg—Li—Cu alloy.

It is anticipated that a weight saving of some 10.5% will be gained by direct replacement of 2000 and 7000 series alloys with a medium strength Al—Mg—Li—Cu alloy.

DESCRIPTION OF THE EXAMPLES

Examples of alloys according to the present invention will now be given.

Alloy billets with compositions according to Table 2 were cast using conventional chill cast methods into 80 mm diameter extrusion ingot. The billets were homogenised and then scalped to remove surface imperfections. The billets were then preheated to 460° C. and extruded into 25 mm diameter bar. The extruded bar was then heat treated to the peak aged condition and the tensile properties, fracture toughness, stress-corrosion and corrosion performance of the material evaluated.

In addition to the 80 mm diameter extrusion ingot described above, billet of 250 mm diameter has also been cast. Prior to extrusion the billets were homogenised and scalped to 210 mm diameter.

Following preheating to 440° C. the billet was then extruded using standard production facilities into a flat bar of section 100 mm×25 mm.

The tensile properties of the alloy derived from the 80 mm diameter ingot are given in Table 3. The 0.2% proof stress and tensile strengths are comparable with those of the conventional 2014-T651 alloy and existing Al—Li—Cu—Mg alloys and show a 25% improvement in strength compared with the Al—Li—Mg alloy system. The fracture toughness of the alloys in the short transverse-longitudinal direction was 16–20 MPa/m which is again comparable with the alloys mentioned above.

Tensile properties, fracture toughness, corrosion and stress corrosion performance of the extrusion derived from the 210 mm diameter billet was assessed in various aging conditions after solution treating for 1 hour at 530° C. and stretching 2%.

Tensile properties of this alloy, designated P41, are given in Table 4.

The chemical composition of this alloy is given in Table 5.

Typical specific strength of the Al—Mg—Li—Cu alloy is given in Table 6, together with values quoted for the earlier generation of aluminium-lithium alloys.

The resistance of the alloys to intergranular corrosion, exfoliation corrosion and stress-corrosion attack was determined in accordance with current ASTM standards. In all tests the alloys exhibited a significant improvement in performance when compared with medium and high strength Al—Li—Cu—Mg alloys.

Stress corrosion testing was carried out in a 35 $gl^{-1}$ sodium chloride solution according to the test methods detailed in ASTM G44-75 and ASTM G47-79.

The Al—Mg—Li—Cu alloys exhibit a much greater resistance to stress corrosion cracking than the new generation of Al—Li—Cu—Mg alloys.

Further improvements in stress corrosion performance can be achieved if the level of copper is maintained at lower end of the range quoted, for example 0.2-0.3 weight percent. However, reducing the copper content to this level will bring about a reduction in tensile strength of 7-10%.

Comparisons of stress corrosion lives of Al—Mg—Li—Cu and Al—Li—Cu—Mg alloys is given in Table 7. These data relate to testing in the short transverse direction with respect to grain flow and at a stress level of approximately 350 MPa.

Susceptibility to exfoliation corrosion was assessed according to the method detailed in ASTM G34-79, the 'EXCO' test.

Following an exposure period of 96 hours the Al—Mg—Li—Cu alloy was assessed to exhibit only superficial exfoliation attack when in the peak aged temper. This compares with ratings of moderate to severe, for a medium strength Al—Li—Cu—Mg alloy and severe to very severe for a high strength Al—Li—Cu—Mg alloy.

Microexamination of the test sections also revealed that the depth of corrosive attack exhibited by the Al—Mg—Li—Cu alloy was reduced by 30 and 60% respectively when compared with the medium and high strength Al—Li—Cu—Mg alloys.

The alloys were also cast into the form of rolling ingot and fabricated to sheet product by conventional hot and cold rolling techniques. The fabrication characteristics of the alloys in Table 2 were compared with a copper free alloy with equivalent alloy additions of lithium, magnesium and zirconium and a similar alloy containing 0.9% copper. Alloys according to the present invention showed a marked improvement in fabrication behaviour such that the final yield of material was increased by at least 50% compared with the comparison alloy.

TABLE 1

Density Comparisons

| ALLOY TYPE | DENSITY (g/ml) |
|---|---|
| Medium strength Al—Li—Cu—Mg alloy | 2.53 |
| High strength Al—Li—Cu—Mg alloy | 2.55 |
| Medium strength Al—Mg—Li—Cu alloy | 2.49 |

TABLE 2

Compositions of the two alloy examples

| Composition (wt %) | Example 1 Identity RGL | Example 2 Identity RGK |
|---|---|---|
| Lithium | 2.5 | 2.4 |
| Magnesium | 3.9 | 3.8 |
| Copper | 0.25 | 0.44 |
| Zirconium | 0.08 | 0.14 |
| Remainder | Aluminium (apart from incidental impurities) | Aluminium (apart from incidental impurities) |

TABLE 3

Tensile properties of the two alloy examples

| | | Tensile properties | | |
|---|---|---|---|---|
| Example | Alloy Code | 0.2% proof stress (MPa) | Tensile stress (MPa) | Elongation % |
| 1 | RGL | 460 | 506 | 3.1 |

TABLE 3-continued

Tensile properties of the two alloy examples

| | | Tensile properties | | |
|---|---|---|---|---|
| Example | Alloy Code | 0.2% proof stress (MPa) | Tensile stress (MPa) | Elongation % |
| 2 | RGK | 484 | 541 | 5.1 |

TABLE 4

Mechanical Properties of the 100 mm × 25 mm section extrusion

| Longitudinal direction | | | Transverse direction | | |
|---|---|---|---|---|---|
| TS MPa | PS MPa | % elongation | TS MPa | PS MPa | % elongation |
| 560 | 450 | 4.5 | 515 | 385 | 7 (1) |
| 581 | 466 | 4.2 | 5.24 | 400 | 4.5 (2) |

(1) Properties measured at room temperature on the underaged temper 4 hours at 190° C.
(2) Properties measured at room temperature on the peak aged temper 16 hours at 190° C.
TS is tensile strength
PS is 0.2% proof stress as in Table 3.

TABLE 5

Chemical composition of the 250 mm diameter extrusion ingot

| Material Identity | Chemical analysis wt % | | | | | | | |
|---|---|---|---|---|---|---|---|---|
| | Li | Mg | Cu | Fe | Si | Zn | Ti | Zr |
| P41-053 | 2.64 | 3.92 | 0.51 | 0.05 | 0.03 | 0.03 | 0.035 | 0.09 |

TABLE 6

Typical specific strength of the earlier generation of aluminium-lithium alloys compared with Al—Mg—Li—Cu alloy

| Alloy Type | Specific Strength TS/P |
|---|---|
| 2020 | 212 |
| 01420 | 186 |
| Al—Mg—Li—Cu | 223 |

TABLE 7

Comparison of stress corrosion lives

| Alloy Type | Stress Level (MPa) | S.C. Life (Days) |
|---|---|---|
| Medium strength Al—Li—Cu—Mg | 350 | 12 |
| High strength Al—Li—Cu—Mg | 350 | 10 |
| Medium strength Al—Mg—Li—Cu | 363 | >20 |
| 10% lower strength Al—Mg—Li—Cu | 345 | >100 |

We claim:

1. An aluminium base alloy having a composition consisting essentially of the following ranges in weight percent:

| | |
|---|---|
| Lithium | 2.1-2.9 |
| Magnesium | 3.0-5.5 |
| Copper | 0.2-0.7 and |

one or more constituents selected from the group consisting of Zirconium, Hafnium and Niobium as follows:

| | |
|---|---|
| Zirconium | 0.05-0.25 |
| Hafnium | 0.10-0.50 |
| Niobium | 0.05-0.30 and |

-continued

| | |
|---|---|
| Zinc | 0–2.0 |
| Titanium | 0–0.5 |
| Manganese | 0–0.5 |
| Nickel | 0–0.5 |
| Chromium | 0–0.5 |
| Germanium | 0–0.2 |
| Aluminium | Remainder (apart from incidental impurities). |

2. An alloy according to claim 1 containing 0.1 to 0.15 weight percent Zirconium.

3. An alloy according to claim 1 containing Lithium in the range 2.4 to 2.6%.

4. An alloy according to claim 3 containing 3.8 to 4.2% Magnesium.

5. An alloy according to claim 4 containing 0.4 to 0.6% Copper.

* * * * *